United States Patent [19]

Bottoms

[11] 3,981,646

[45] Sept. 21, 1976

[54] GEAR PUMPS AND MOTORS

[75] Inventor: Harry Simister Bottoms, Solihull, England

[73] Assignee: Lucas Aerospace Limited, Birmingham, England

[22] Filed: Nov. 19, 1975

[21] Appl. No.: 633,562

Related U.S. Application Data

[62] Division of Ser. No. 450,483, March 12, 1974, Pat. No. 3,953,160.

[30] Foreign Application Priority Data

Mar. 15, 1973 United Kingdom ..... 12545/73

[52] U.S, Cl. ..... 418/190

[51] Int, Cl.[2] ..... F04C 1/04; F04C 15/00

[58] Field of Search ..... 418/189, 190

[56] References Cited

UNITED STATES PATENTS

| | | | |
|---|---|---|---|
| 1,686,867 | 10/1928 | Kuhn | 418/190 |
| 1,728,528 | 9/1929 | Butler | 418/190 |
| 1,728,529 | 9/1929 | Butler | 418/190 |
| 2,344,628 | 3/1944 | Monahan | 418/190 |
| 2,601,003 | 6/1952 | Pontius | 418/190 |
| 2,845,031 | 7/1958 | Guibert | 418/190 |
| 3,439,625 | 4/1969 | Warne | 418/190 |
| 3,574,490 | 4/1971 | Hartmann | 418/190 |

FOREIGN PATENTS OR APPLICATIONS

| | | | |
|---|---|---|---|
| 578,809 | 7/1946 | United Kingdom | 418/190 |

*Primary Examiner*—C. J. Husar

[57] ABSTRACT

A gear pump or motor includes a housing having an 8-shaped chamber, a pair of meshed gears in the chamber and a pair of ports opening into the chamber on opposite sides of the zone of mesh of the gears. The teeth of the gears have on their non-working flanks relieved portions adjacent the tip and the root of the tooth which are arranged to leave an unrelieved land across the entire non-working flank.

1 Claim, 9 Drawing Figures

GEAR PUMPS AND MOTORS

This is a division of application Ser. No. 450,483, filed Mar. 12, 1974, now U.S. Pat. No. 3,953,160.

This invention relates to gear pumps and motors of the kind comprising a pair of meshed pinion elements in an 8-shaped chamber in a housing having ports communicating with the chamber on opposite sides of the zone in which the gears are meshed.

If a pump of this kind is always driven in the same direction, as will occur when it is used in an aircraft fuel system, only one flank (hereinafter called "the working flank") of each gear tooth engages the teeth of the other gear, a small clearance being present between the other flank (hereinafter called "the non-working flank") of the tooth and the other gear. This has been found to cause erosion of the non-working flanks and it is an object of the invention to provide a gear pump of the kind specified in which the possibility of such erosion occurring is reduced.

According to the invention the non-working flank of each tooth has relieved portions adjacent its root and adjacent its tip, an unrelieved land extending across the entire width of the non-working flank between said relieved portions.

In the accompanying drawings:

FIG. 1 is a longitudinal section through an example of a pump in accordance with the invention;

FIGS. 2 and 3 are sections taken on lines 2—2 and 3—3 respectively in FIG. 1;

Figure 1:
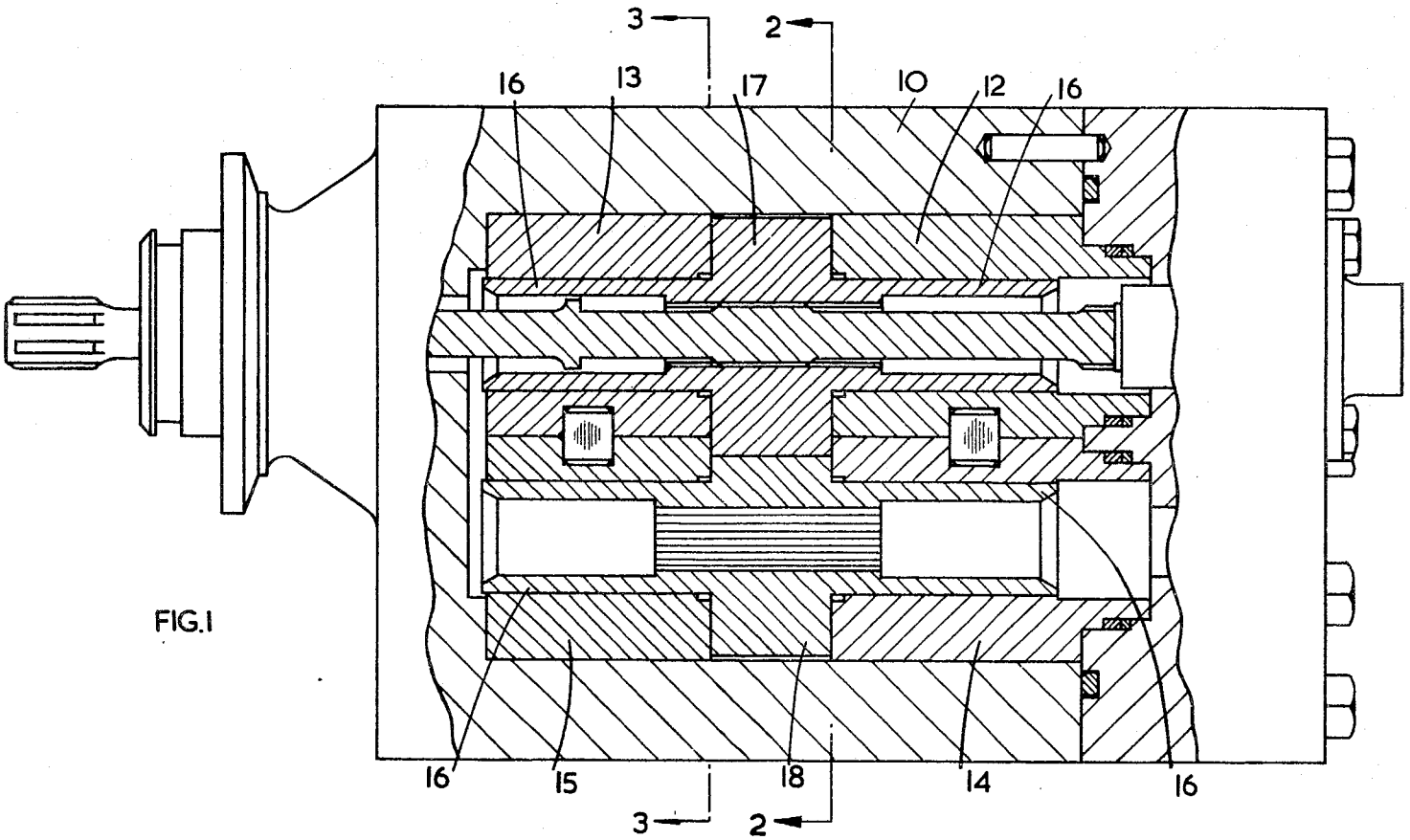
Figure 2:
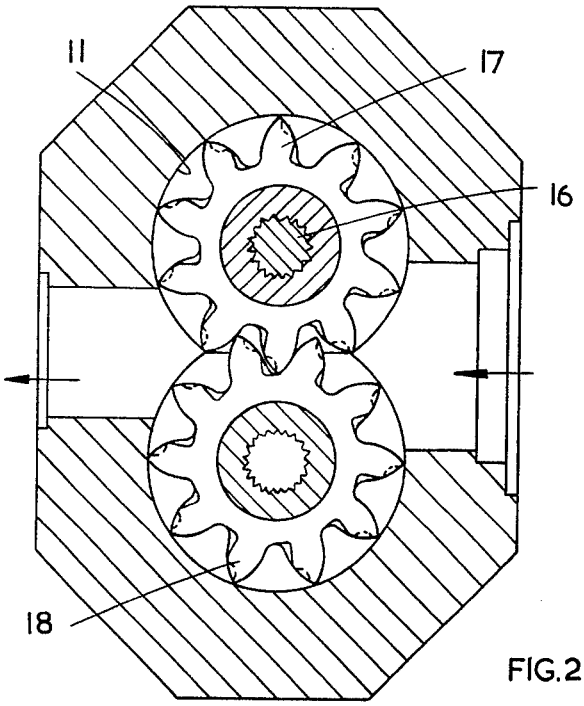

The pump shown in FIGS. 1 to 5 includes a housing 10 formed with a pair of longitudinal bores the axes of which are spaced by a distance less than the diameter of the bores so as to define a chamber 11 of 8-shaped configuration. Mounted in these bores are two pairs of bearing blocks 12, 13, 14, 15, each of which is cylindrical with a flat abutting the other block of the pair. These blocks 12, 13, 14, 15 support trunnions 16 on two gears 17, 18 which are interposed between the bearing blocks and are meshed together. The gear 17 is connected to a splined drive shaft 19 whereas the gear 18 is merely an idler.

Figure 4:
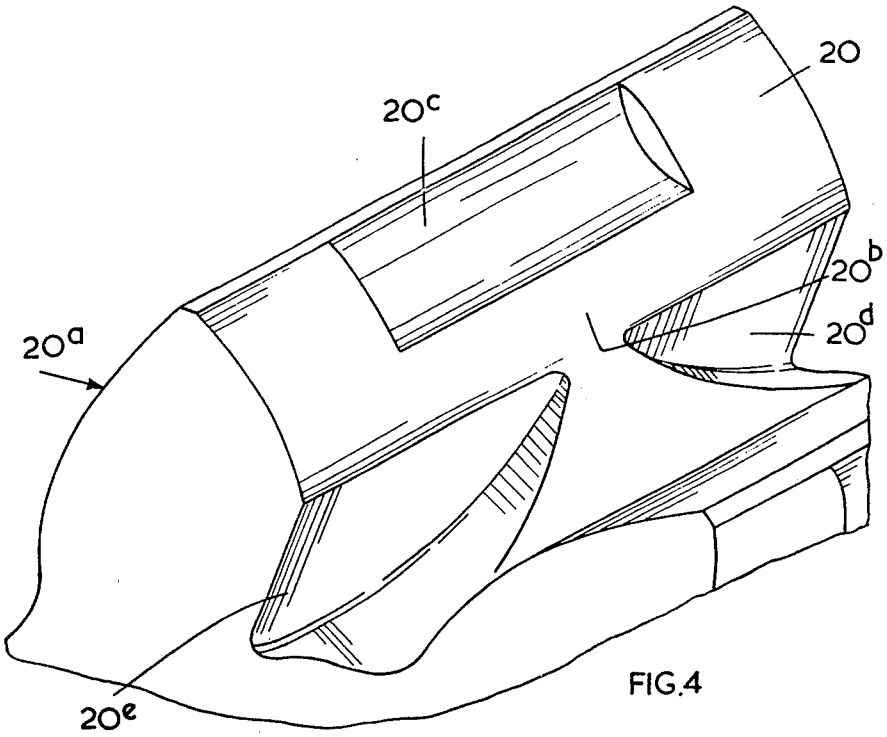
FIG. 4 is an enlarged perspective view of one tooth of a gear forming a part of the pump.

Each tooth 20 of each gear 17, 18 is as shown in FIG. 4, that is it has a working flang **20*a* and a non-working flank 20*b*. The non-working flanks 20*b* of all the teeth of both gears are relieved as shown. Thus there is a relieved portion 20*c* adjacent the tip of the tooth at the centre of the flank 20*b* and two further relieved portions 20*d*, 20*e*** at opposite ends of the tooth adjacent the root thereof.

This arrangement of relieved areas ensures that the non-working flanks of the teeth of each gear have non-relieved portions extending from the root to the tip which can co-act with the identically disposed non-relieved portions of the teeth on the other gear to limit the backlash between the gears. In addition there is a continuous unrelieved strip of the non-working flank which extends from one end of the flank to the other at a position intermediate the root and the tip and the purpose of this non-relieved strip will be explained further hereinafter.

Figure 3:
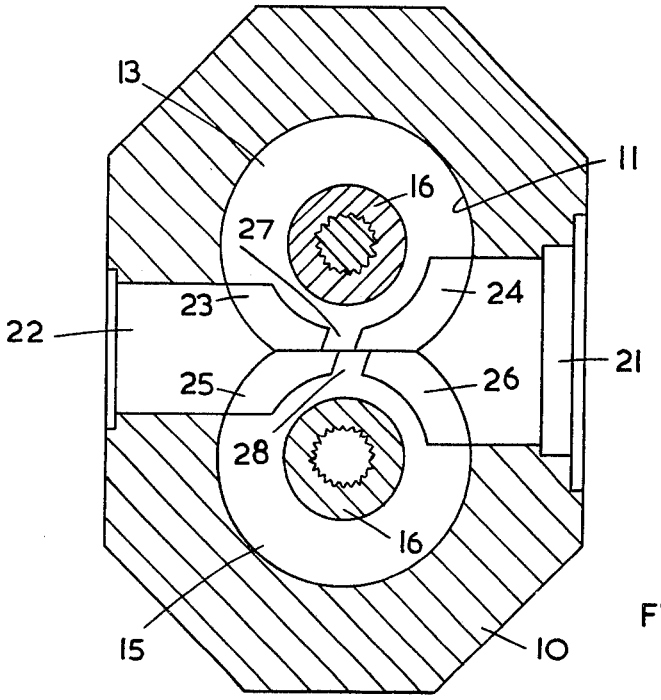

Turning now to FIG. 3 the ends of the bearing blocks 12, 13, 14, 15 adjacent the gears have non-planar surfaces to permit liquid in the inlet port 21 and the outlet port 22 to communicate with the axial ends of the inter-tooth spaces in the gears right up into the zone of mesh of the gears. As shown each bearing block has two relieved zones 23, 24, or 25, 26 which communicate with the ports. These zones are separated by bridge portions 27, 28 which prevent direct flow through the relieved zones from the outlet port 22 back to the inlet port 21.

Figure 5:
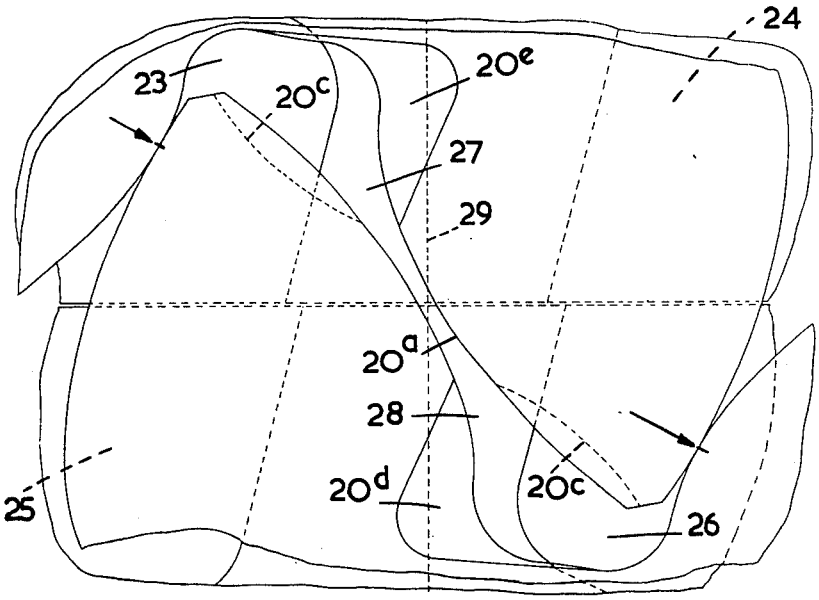
FIG. 5 is a diagram illustrating the relationship between the gear teeth and ports of the pump.

FIG. 5 shows the relationship between the bridge portions 27, 28 and the gear teeth 20 with their relieved non-working flanks in more detail. The drawing shows the condition which occurs when the centre of the backlash between the non-working flanks of two teeth of the gears is at the centre point of the pump, i.e. a point midway between the axes of the two gears 17, 18 on a line 29. It will be observed that the two gears define between them a space closed at opposite ends by the line contacts between the working flanks of the teeth. In the position shown the volume of this space is at a minimum. It will also be observed that both ports communicate with this space in the position shown via the relieved zones 23 and 26. Thus, although the bridge portions 27, 28 prevent direct communication between the ports, such communication is permitted by the gears. Such communication is, however, restricted by the non-relieved strips on the non-working flanks of the gears so that pressure loss resulting from leakage through the backlash is likewise restricted.

As the gears rotate out of the position shown in FIG. 5, the total volume of the space between the two contact lines starts to increase (so drawing liquid into the space through the inlet port 21), but the volume of the portion of this space on the high pressure side of the backlash gap will continue to decrease until the centre of the space between the teeth on the driver gear 17 is on the line 29. At this point the tooth space is isolated from the outlet port and connected at both sides of the backlash gap to the low pressure port as the relieved portion **20*a* travels off the bridge portion 27.**

During this movement it is evident that flow takes place through the backlash gap, but the relieving of the teeth at **20*c*, 20*d* and 20*e*** ensures that virtually all parts of the non-working flanks not actually forming the backlash gap will be subjected to low flow velocities. When no relief is provided the high velocity flow through the backlash gap creates turbulence downstream of this gap and this in turn gives rise to cavitation in the liquid (particularly when the liquid is near its boiling point which can occur at high altitude). If the cavities collapse at positions adjacent the non-working flanks of the gears, erosion of the non-working flanks can occur. Such erosion has, in fact, been observed in actual aircraft fuel pumps in the zones of the non-working flanks adjacent the roots and tips thereof. The cavitation which occurs at high altitudes is very difficult to prevent. The relieving of the teeth described above, however, ensures that the collapse of the cavities does not take place adjacent the flank surfaces and the erosion of the teeth is therefore prevented or at least deferred.

Figure 6:
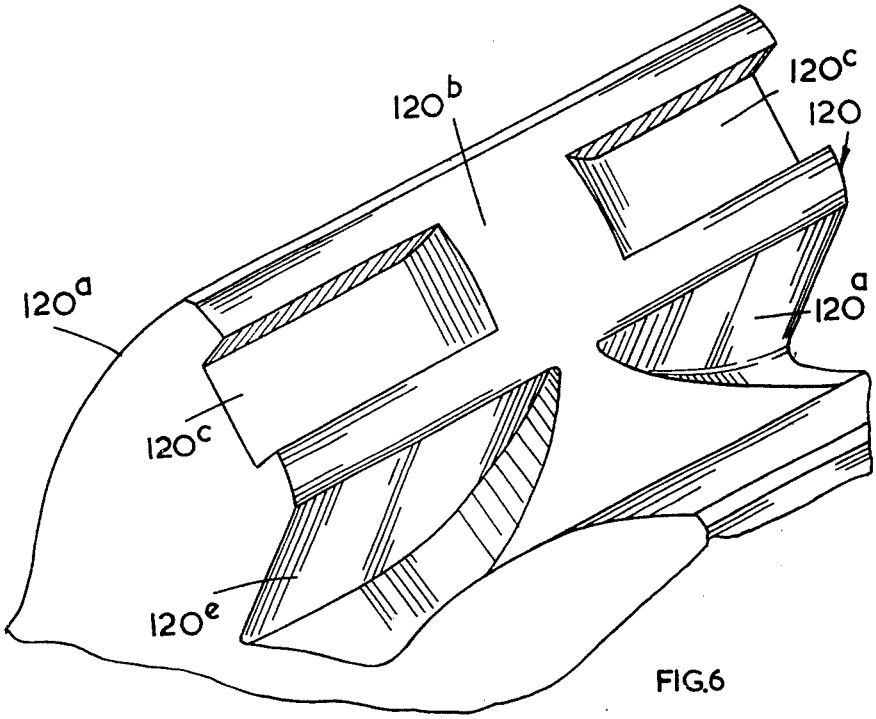
FIG. 6 is a view like FIG. 4 but showing another example of the invention.
Figure 7:
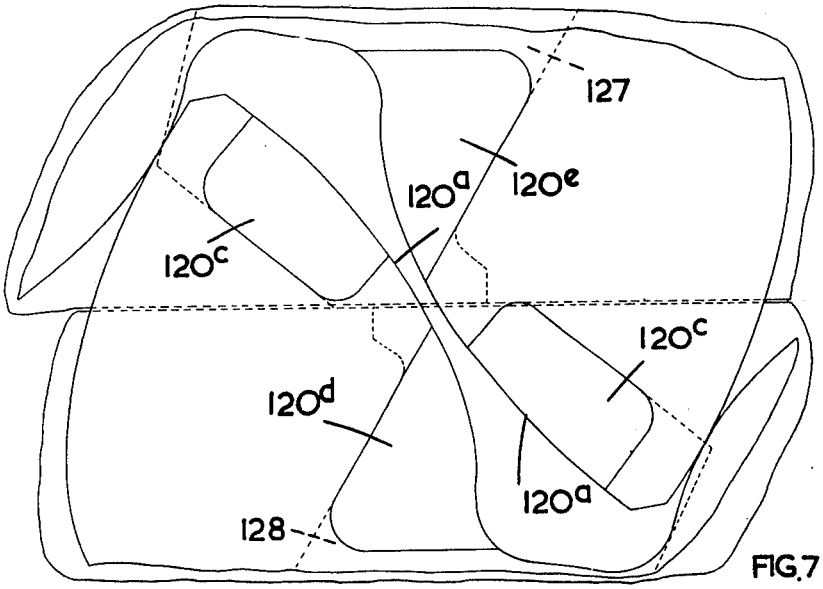
FIG. 7 is a diagram like FIG. 5 of the tooth/port relationship for the pump of FIG. 6.

Turning now to the example shown in FIGS. 6 and 7 it will be observed that the tooth 120 is again relieved on its non-working flank 120*a*, but in this case there are two relieved portions 120*c* adjacent the tip and two 120*d*, 120*e* adjacent the root. The shape of the bridge portions 127, 128 on the bearing blocks is altered to take account of the different end profile of the teeth and it will be observed that in the position shown in FIG. 7 the space between the teeth does not communicate with either port. A small displacement of the gears in either direction would effect connection of the space to one port or the other, but no leakage from port to port through the space can occur. Whilst this is clearly an ideal configuration, it is difficult to attain in production, since the unavoidable tolerances on the cutting of the relief of the teeth and the bearing blocks could result in an arrangement in which the space was closed before this position (leading to hydraulic locking) or to remain closed after this position, giving rise to cavitation and consequent erosion of the teeth.

Figure 8:
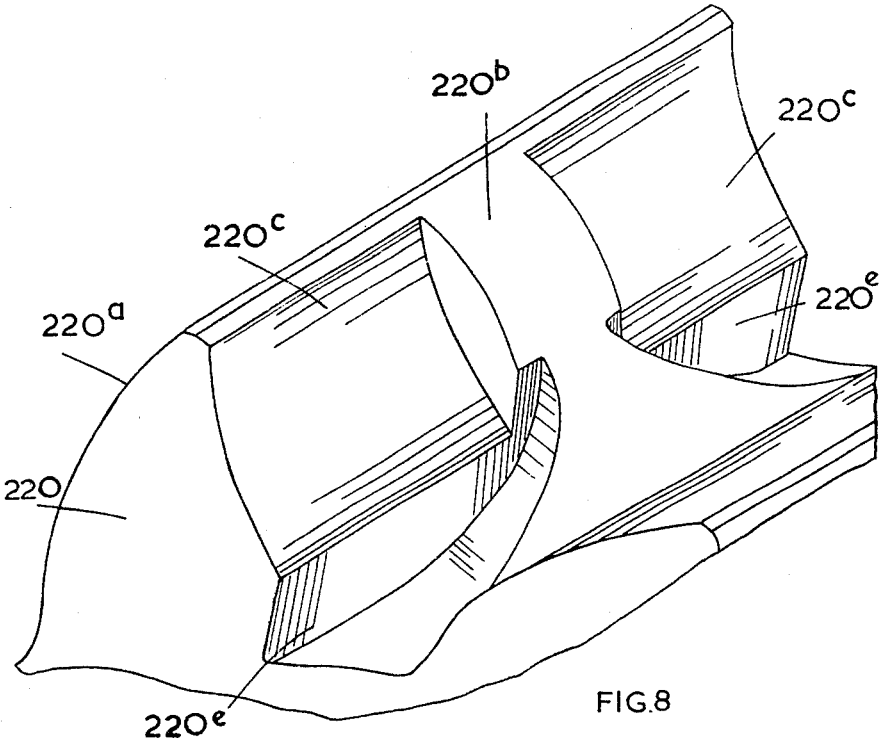
FIG. 8 is yet another view like FIG. 4 showing a further example of the invention.
Figure 9:
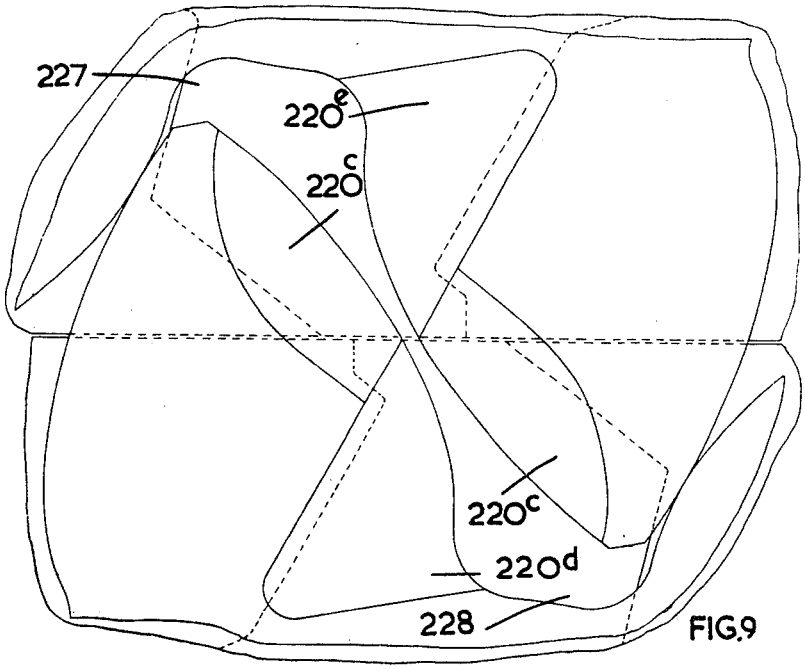
FIG. 9 is a diagram like FIG. 4 for the pump of FIG. 8.

In the final example shown in FIGS. 8 and 9 the relieved portions of the non-working flanks at the root 220*d* and 220*e* and the tip 220*c* of each tooth intersect so that there is no non-relieved strip along each tooth, but merely a non-relieved strip running in the transverse direction, i.e. from root to tip. This strip merely controls backlash and the flow restricting function of the strip in the embodiment of FIGS. 1 to 5 is not obtained. The design of the bridge portions 227, 228 is therefore such that, although both ports open into the inter-tooth spaces simultaneously, flow restriction is obtained by ensuring that such simultaneous opening is limited. These dimensions are chosen to ensure that there is simultaneous opening for all tolerance combinations.

With this arrangement during direct port-to-port communication the maximum flow velocities occur at the entry and exit to the tooth space since there is no narrow restriction presented by the backlash gap. Thus any cavitation which occurs will be in the relieved portions of the teeth and no damage which can affect performance is likely.

I claim:

1. A gear pump or motor comprising a housing having therein an 8-shaped chamber with ports communicating with the chamber on opposite sides thereof, a pair of meshed pinion elements running in said 8-shaped chamber, and a shaft connected to one of the said pinion elements and projecting from the housing, each pinion element being supported in bearing blocks with non-planar surfaces forming relieved zones, each pinion element having a plurality of teeth each of which has a working flank, which engages the working flanks of teeth on the other pinion, and a non-working flank, each axial end portion of the non-working flank of each tooth of each pinion having a respective relieved portion adjacent its root, which relieved portion extends to the respective axial end of the non-working flank, and a further relieved portion adjacent its tip intermediate the axial ends of the non-working flank, each non-working flank having an unrelieved land extending across the entire width of the non-working flank from the root to the tip, said unrelieved land also including a longitudinal strip extending from one axial end of the non-working flank to the other at a position intermediate the root and the tip, and wherein the ports in the housing communicate with the inter-tooth spaces via the relieved zones in the bearing blocks and the relieved portions of the non-working flanks of the teeth at axial ends thereof.

* * * * *